United States Patent [19]

Elmore et al.

[11] 4,437,375

[45] Mar. 20, 1984

[54] MOLDED FRAME MAKER MITRE BOX WITH CLAMPS

[75] Inventors: James Elmore, Simsbury; Robert F. West, West Simsbury, both of Conn.

[73] Assignee: The Stanley Works, New Britain, Conn.

[21] Appl. No.: 313,477

[22] Filed: Oct. 21, 1981

[51] Int. Cl.[3] ..... B27G 5/02

[52] U.S. Cl. ..... 83/762; 269/41

[58] Field of Search ..... 83/761, 762, 763; 269/41

[56] References Cited

U.S. PATENT DOCUMENTS

| | | | |
|---|---|---|---|
| 345,590 | 7/1886 | Hinze | 83/762 |
| 2,322,433 | 6/1943 | Gammache | 83/762 |
| 2,761,476 | 9/1956 | Gunas | 269/41 X |

*Primary Examiner*—Donald R. Schran

[57] ABSTRACT

A mitre box has an integrally formed synthetic resin support member which includes a platform portion, a corner post with right angularly disposed faces, a pair of clamp posts spaced from the corner post and a saw guide post disposed between the clamp posts. The corner post has a transverse channel bisecting the 90° angle defined by its vertical faces, and the saw guide post has a channel aligned therewith so that a saw blade may be guided when seated in these two cooperating channels to effect a 45° cut in a workpiece abutting one of the vertical faces of the corner post. Clamp assemblies are adjustably mounted in the clamp posts and include elongated members which are adjustably moveable therein relative to the cooperating vertical faces of the corner posts.

12 Claims, 11 Drawing Figures

MOLDED FRAME MAKER MITRE BOX WITH CLAMPS

BACKGROUND OF THE INVENTION

As is well known, mitre boxes are widely employed for cutting the ends of workpieces at desired angles, and there are many forms of support for the workpieces and for guiding the saw. Some mitre boxes are dedicated to the cutting of workpieces to provide frame elements with the cut being oriented at 45°; in these, the saw blade is positioned by elements of the box relative to the guide surface for the workpiece so as to provide the 45° angle at the time of the cut. Some frame maker mitre boxes will permit some adjustment in this angle while effectively retaining the dedicated concept in the interest of reducing cost and insuring accuracy of the cuts.

With the increase in the home handyman market, there has been an increasing need to produce low cost tools for use by such handymen but which provide accuracy and reasonable durability. Moreover, there has been a continuing need to provide relatively lightweight mitre boxes which are easily transported to the place where the job will be performed. A number of companies have developed mitre boxes which are fabricated in large measure from synthetic resins to reduce both cost and weight. Exemplary of such intergrally formed resin mitre boxes is that disclosed in Hildebrandt et al U.S. Pat. No. 3,935,779 granted Feb. 3, 1976.

It is an object of the present invention to provide a novel frame maker mitre box employing an integrally formed synthetic resin support member.

It is also an object to provide such a mitre box which is reasonably low cost and readily fabricated and which will exhibit a relatively long life commensurate with ease of handling and light weight for ready transport.

A further object is to provide such a mitre box which is simple to use to provide 45° cuts in frame pieces and which employs a minimum of parts.

SUMMARY OF THE INVENTION

It is now been found that the foregoing and related objects may be readily attained in a mitre box especially adapted for making the elements of picture frames and the like, and which includes an integrally formed synthetic resin support member and a pair of adjustable clamp assemblies. The support member includes a platform portion providing generally planar upper surface, a corner post extending upwardly therefrom and having right angularly disposed vertical faces bordering the upper surface of the platform portion, and a pair of clamp posts spaced to the opposite sides of the platform portion from the vertical faces of the corner post and extending upwardly from the platform portion. A saw guide post extends upwardly from the upper surface of the platform portion between the clamp posts and on the side of the platform portion opposite from the corner post.

The corner post has a channel extending transversely therethrough and downwardly thereinto from its top surface, and this channel bisects the 90° angle defined by the cooperating vertical faces of the corner post. The saw guide post has a channel extending transversely therethrough and downwardly thereinto from its top surface, and this channel is aligned with the channel in the corner post so that a saw blade may be guided in these channels to cut the end of a workpiece extending parallel to and abutting one of the corner post vertical faces, at substantially a 45° angle.

Clamp assemblies are adjustably mounted on each clamp post, and each includes an elongated member having its longitudinal axis extending perpendicularly to the cooperating vertical face of the corner post and supported in its clamp post for adjustable movement towards and away from the cooperating vertical face of the corner post. The end of the elongated member adjacent to the corner post has a clamping face for engagement with the workpiece to hold it against the cooperating face of the corner post.

In the preferred embodiment, the elongated member of the clamp assembly is threadably engaged in its respective post to provide threadably adjustable movement of the clamping face relative to the vertical faces of the corner post. The clamp post has a recess therein extending transversely of the elongated member, and the clamp assembly includes an internally threaded member seated in this post recess and through which the elongated member threadably extends to provide the adjustable movement. Preferably, the elongated member has a handle at the outer end thereof to facilitate adjustment.

In a highly desirable embodiment of the invention, the clamp assembly includes a separately formed clamping shoe mounted on the clamping end of the elongated member to provide the clamping face. The clamping shoe has an aperture therein which receives the end of the elongated member. To provide variation in spacing of the shoe above the upper surface of the platform portion of the support member, the aperture may be spaced more closely to one horizontal surface of the shoe than to the other so that pivoting the shoe 180° about the elongated member will effect the desired variance in the spacing. The shoe is preferably fabricated from a synthetic resin which provides durable characteristics and will avoid marring of the workpieces.

Desirably, the corner post has a second vertical channel therein spaced from the first mentioned channel, and this channel extends transversely therethrough and downwardly thereinto along a line perpendicular to one of the right angularly disposed vertical faces. The clamp post cooperating with that vertical face is also provided with a channel aligned with the second channel of the corner post, and this channel extends transversely therethrough and downwardly thereinto from the top surface of the clamp post. As a result, a saw blade may be guided in the second channel of the corner post and the clamp post channel to cut the end of the workpiece abutting that vertical face of the corner post, at substantially a 90° angle.

In accordance with the preferred construction, the several channels extend from the top surface of the posts to below the plane of the upper surface of the platform portion, and the upper surface of the platform portion has a channel therein which extends between the channels of the saw guide post and corner post.

Desirably, the support member has a lower surface which is defined by a peripheral skirt and intersecting ribs. The post members are of hollow construction with transverse ribs providing the walls defining the channels. The support member is preferably provided with a spaced pair of depending foot portions having vertical surfaces adapted to abut the sides of a worktable. In the preferred embodiment, these foot portions have first vertical surfaces extending in alignment to permit stable placement against a longitudinal edge of a worktable and a pair of opposed vertical faces defining a right angle therebetween to permit stable placement at the corner of a worktable.

DETAILED DESCRIPTION OF THE ILLUSTRATED EMBODIMENTS

Figure 1:
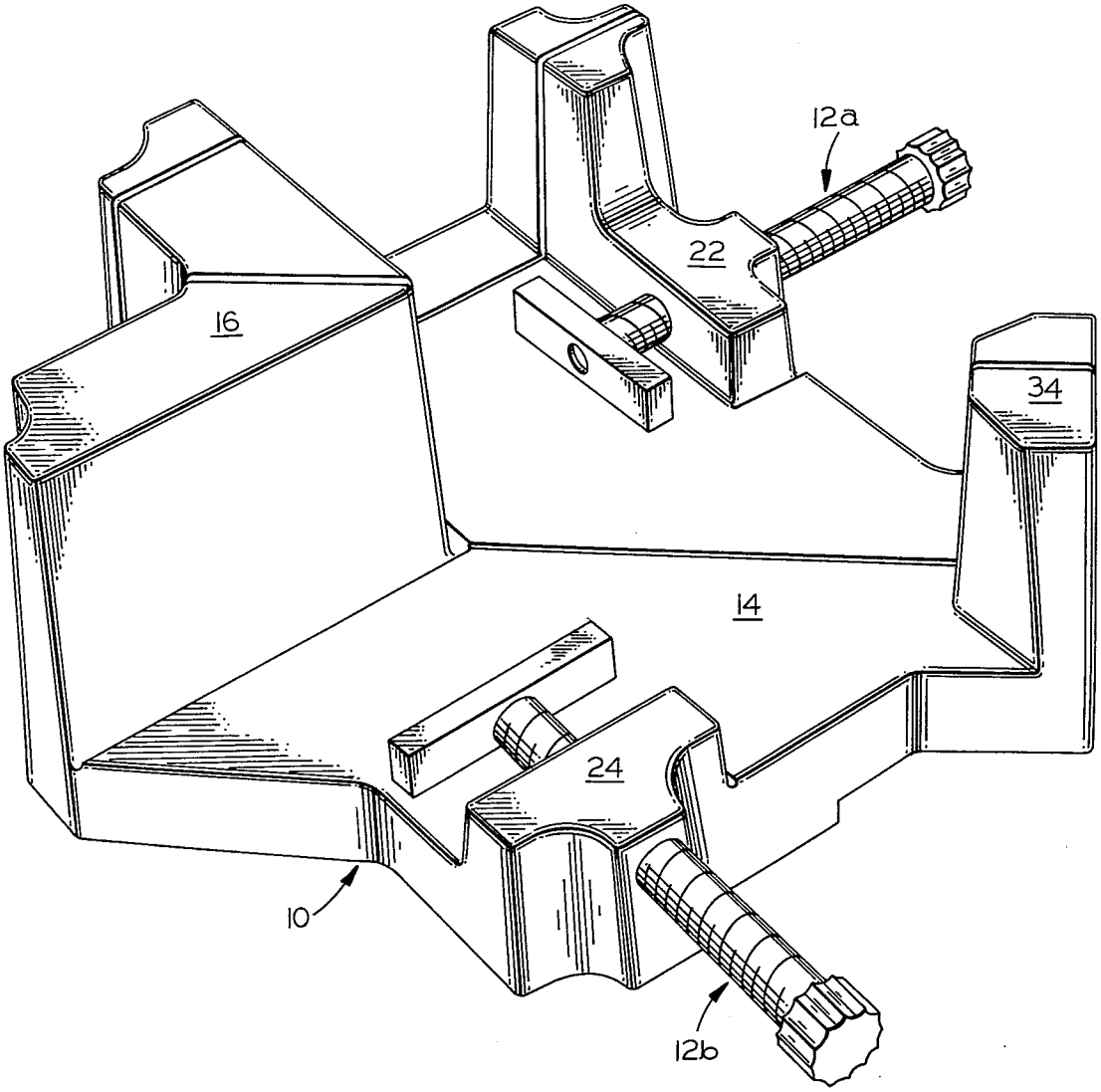
FIG. 1 is a perspective view of a molded frame maker mitre box embodying the present invention.

Turning first to FIG. 1 of the attached drawings, the molded frame maker mitre box of the present invention is comprised of the support member generally designated by the numeral 10, and a pair of clamp assemblies supported therein and generally designated by the numeral 12*a*, 12*b*.

Turning now in detail to the support member 10, it is molded from synthetic resin, and has a platform portion 14 having a generally planar upper surface on which will be disposed the workpieces (not shown). A corner post 16 of generally L-shaped cross-section rises above the platform portion 14, and its inwardly facing surfaces provide a pair of vertical faces 18, 20 defining a right angle therebetween. Extending upwardly at the opposite sides of the platform portion 14 opposite each of the vertical faces 18, 20 of the corner post 16 are clamp posts 22, 24 which have generally vertically extending inner faces 26, 28 extending parallel to the vertical faces 18, 20 of the corner post 16. The clamp post 22 also has a lateral extension 30 which is of greater height than the body portion 32 for a purpose which will be more fully described hereinafter. Extending upwardly at the remaining corner of the platform portion 14 and between the clamp posts 22, 24 is a saw guide post 34.

The corner post 16 has a vertical slot-like channel 36 which extends therethrough and downwardly thereinto from its top surface to below the upper surface of the platform portion 14, and which is located along an imaginary line bisecting the right angle defined by the vertical faces 18, 20. It will be appreciated that the post 16 is molded so as to provide the side walls and the bottom wall defining the channel 36.

Aligned with the channel 36 in the corner post 16 is a vertical channel 38 in the saw guide post 34 which extends transversely therethrough from its top surface to below the upper surface of the platform portion 14. As it can be seen in FIG. 2, this channel 38 is located along the imaginary line bisecting the right angle defined by the vertical faces 18, 20 of the corner post 16.

Figure 2:
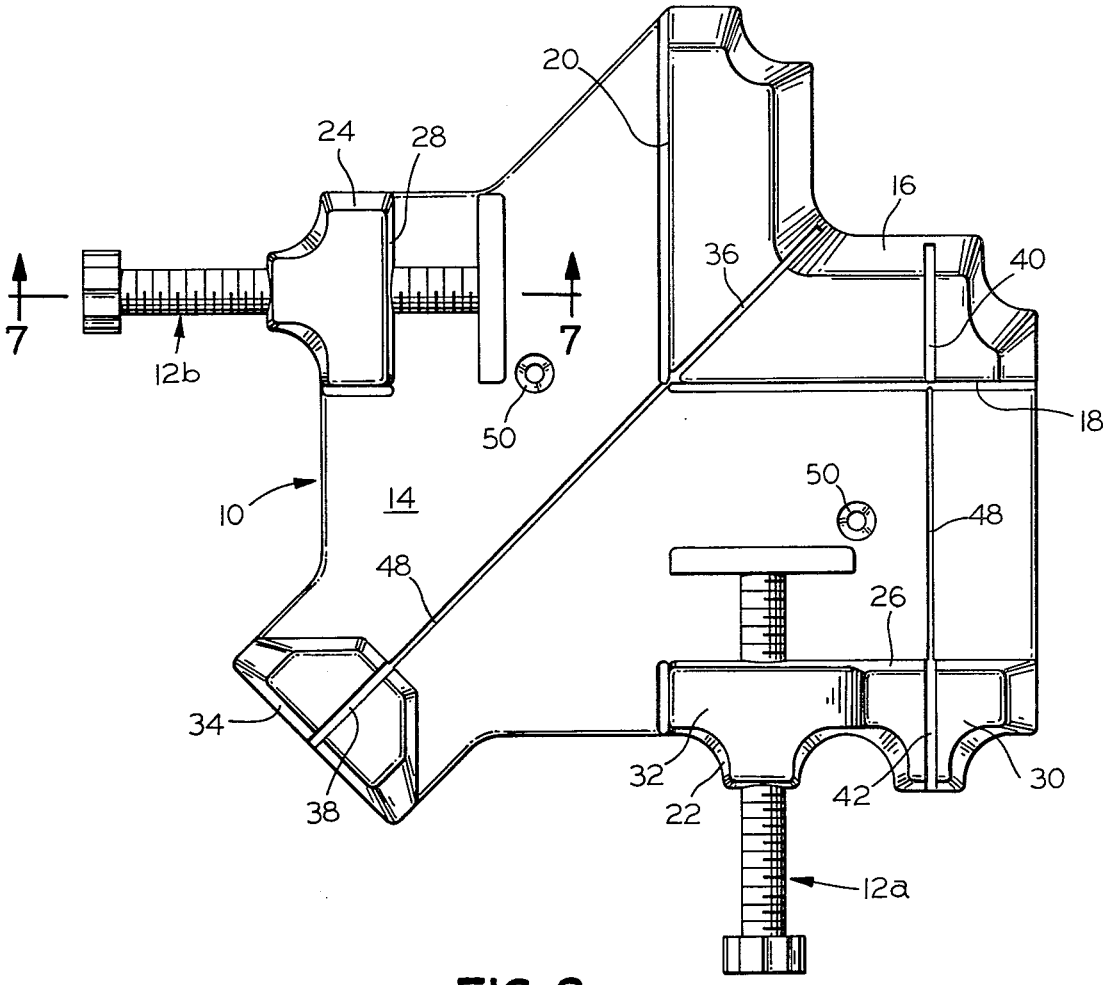
FIG. 2 is a top plan view thereof.
Figure 3:
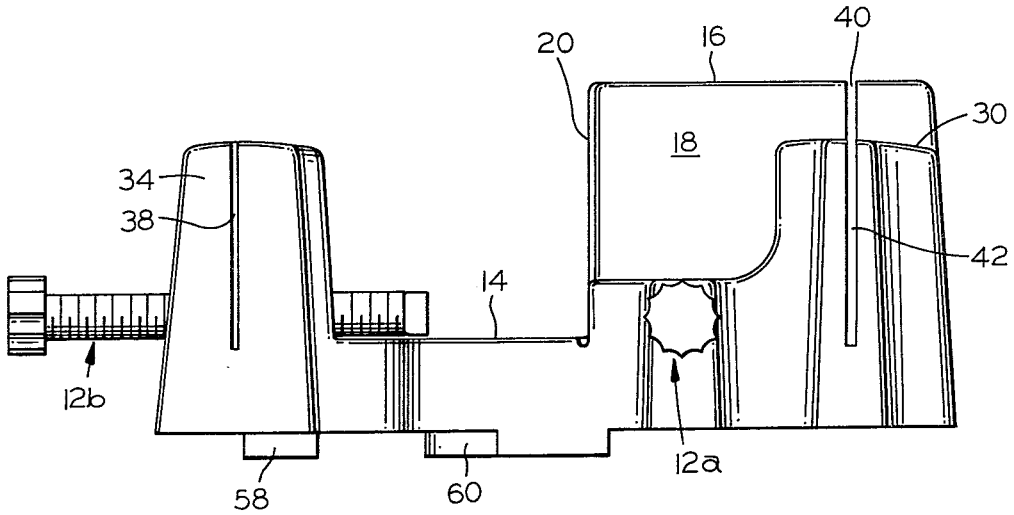
FIG. 3 is an elevational view thereof looking from the bottom of FIG. 2.

The corner post 16 also has a channel 40 spaced along the vertical face 18 from the channel 36 and which similarly extends transversely therethrough and downwardly thereinto from its top surface and which is perpendicular to the vertical face 18. The clamp post 22 has in its extension 30, a channel 42 which is aligned with the channel 40 and which extends transversely therethrough and downwardly thereinto from its top surface to below the upper surface of the platform portion 14. As seen in FIG. 2, this channel 42 is located along an imaginary line perpendicular to the vertical face 18.

As best seen in FIGS. 1 and 2, the upper surface of the platform portion 14 has a pair of channels 48 extending downwardly thereinto and between the channels 36, 38 and 40, 42.

Figure 4:
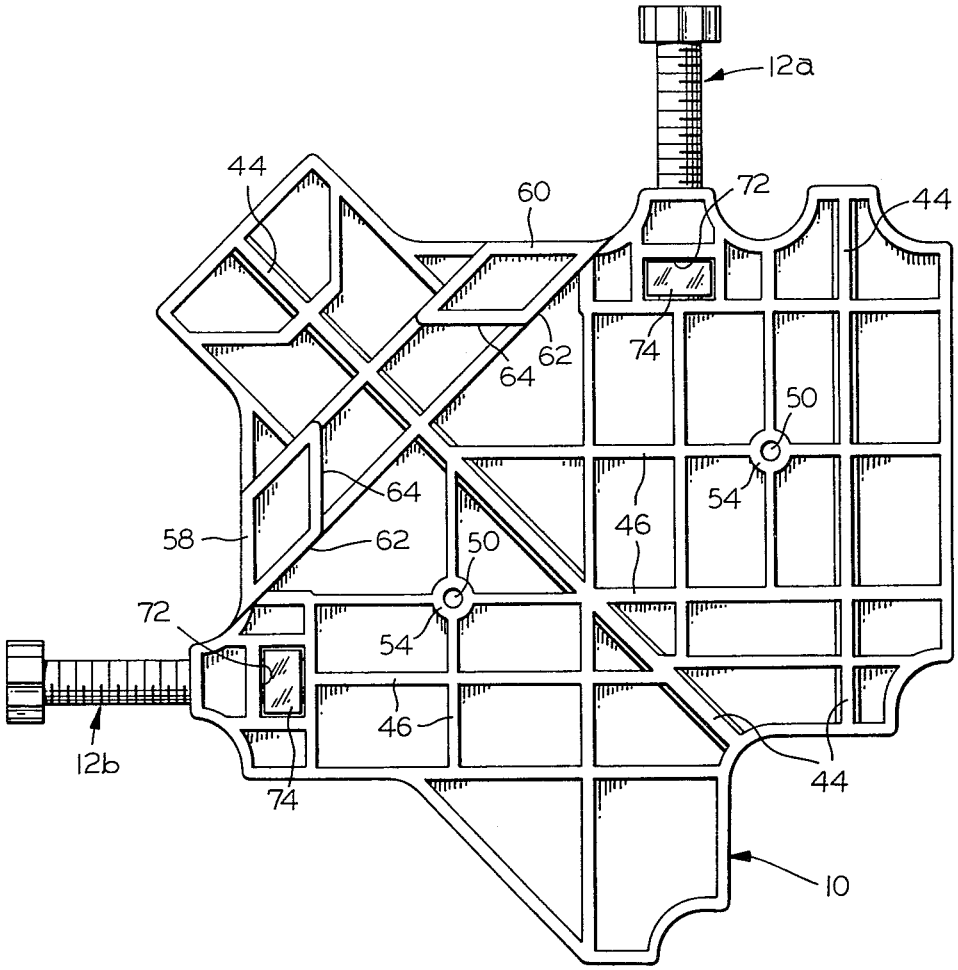
FIG. 4 is a bottom view thereof.
Figure 5:
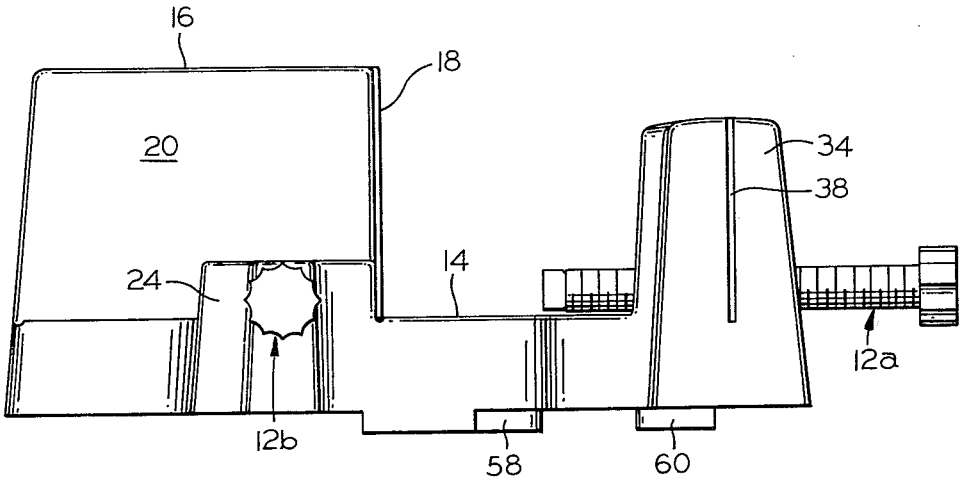
FIG. 5 is an elevational view of another side thereof looking from the left of FIG. 2.

As best seen in FIG. 4, the support member 10 is of generally hollow construction in the area of the several posts with transversely extending ribs 44 providing the side and bottom walls of the several channels in the posts and in the support member platform portion 14. These channel ribs 44 also strengthen the hollow post structures. Moreover, the platform portion 14, while providing a generally planar upper surface, employs a series of intersecting ribs 46 on its lower surface to reduce the amount of material required while providing a high degree of strength.

Figure 6:
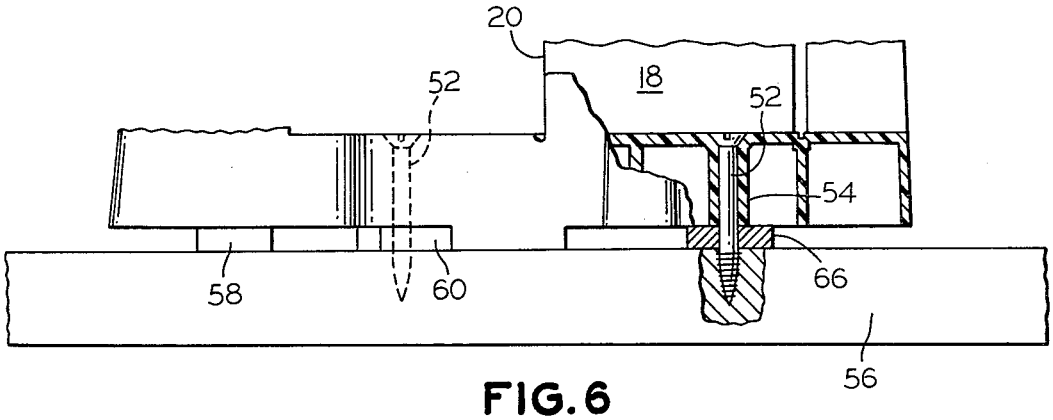
FIG. 6 is a fragmentary elevational view in partial section showing the mitre box mounted upon a fragmentarily illustrated workbench and with a shim thereunder.

As can be seen in FIGS. 2, 4, and 6, a pair of apertures 50 extend through the platform portion 14 to receive fasteners 52. These apertures 50 are provided in circular bosses 54 for strength, and the fasteners 52 secure the mitre box to the upper surface of a workbench 56 or the like.

Figure 10:
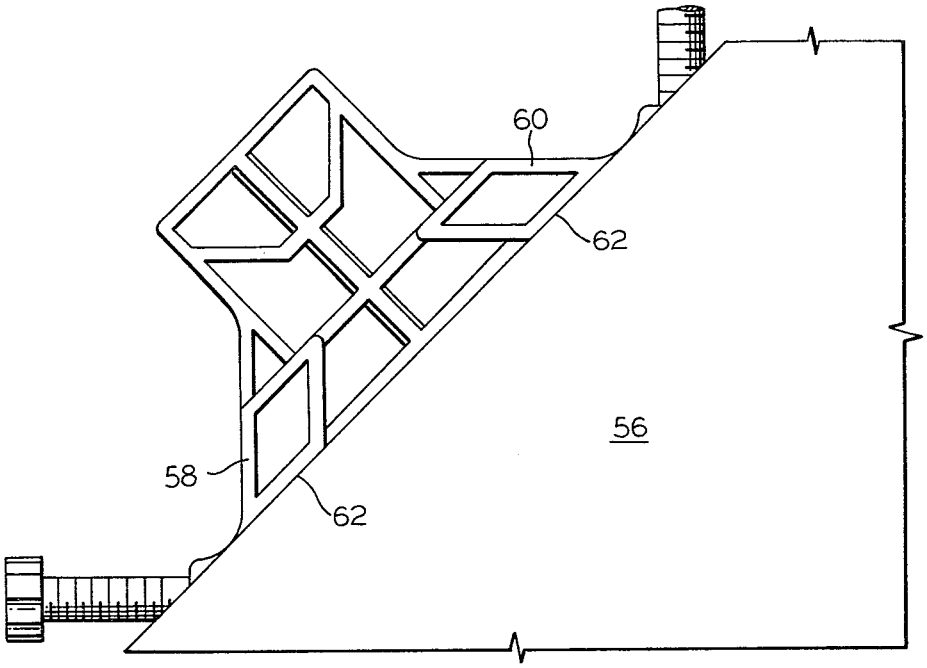
FIG. 10 is a fragmentary bottom view of the mitre box as disposed against the longitudinal edge of a fragmentarily illustrated workbench.
Figure 11:
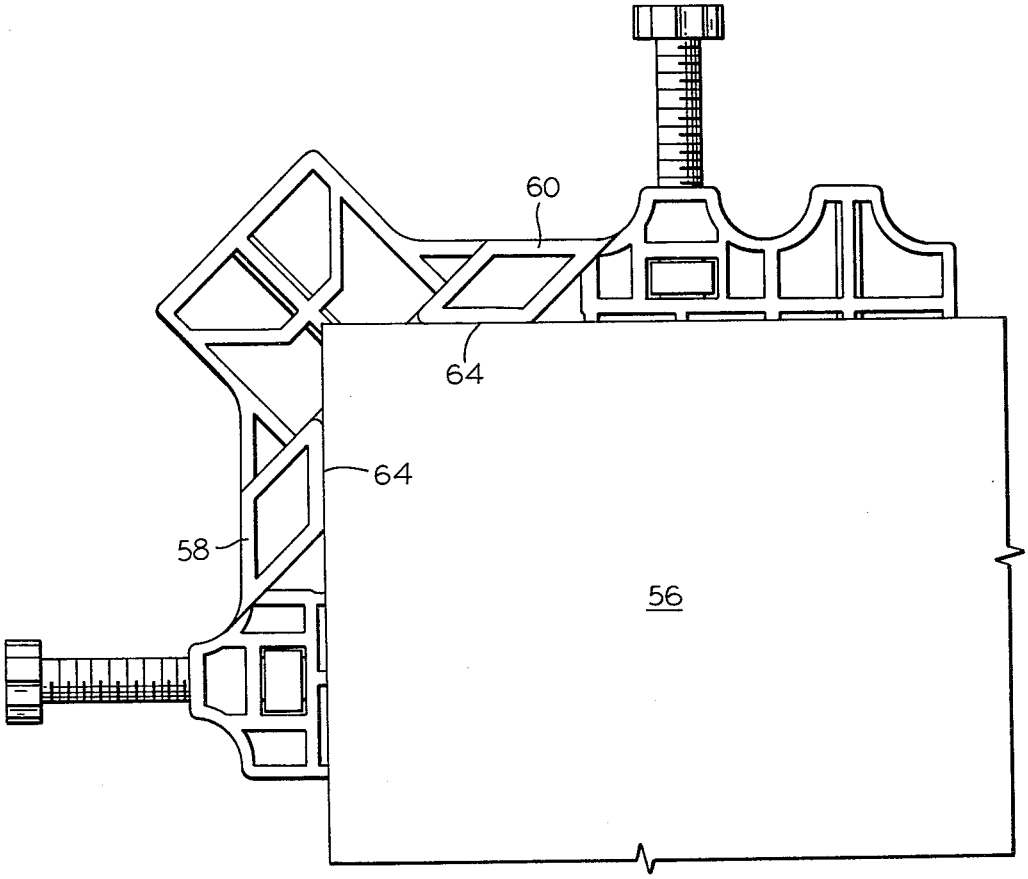
FIG. 11 is a view similar to FIG. 10 with the mitre box disposed at a corner of the workbench.

As best visualized from FIGS. 10 and 11, the bottom surface of the platform portion 14 is configured to provide two spaced apart depending leg portions 58, 60 which have aligned inner vertical faces 62, and opposed vertical faces 64 which converge along imaginary lines at a right angle. As seen in FIG. 10, this permits the mitre box to be stabilized by placing it along the longitudinal edge of a worktable 56 and holding it thereagainst during the working operation, with or without the addition of screws or like fasteners 52 as shown in FIG. 6. In FIG. 11, the mitre box is similarly stabilized by placing it so that the corner of the workbench 56 is received between the opposed faces 64.

In the mounting arrangement shown in FIG. 6, the mitre box is placed upon the upper surface of the workbench 56. In order to provide stability and accomodate the variation in height occasioned by the leg portions 58, 60, a shim 66 is placed under the mitre box to provide a third "leg".

Figure 7:
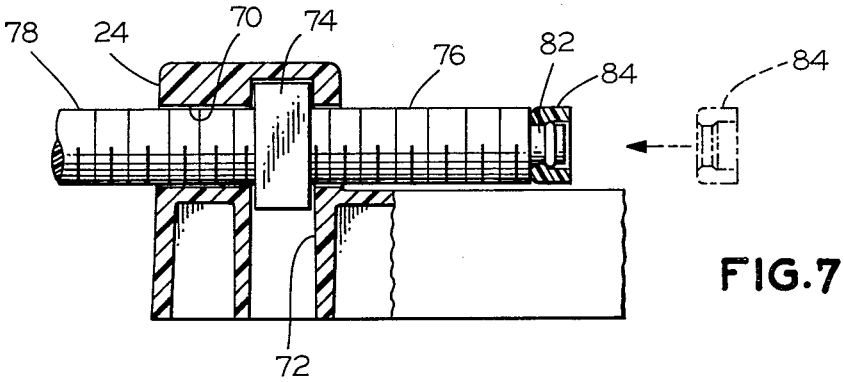
FIG. 7 is a fragmentary sectional view along the line 7—7 of FIG. 2 drawn to an enlarged scale and showing a clamp shoe in phantom line.

Turning now to the clamp assemblies 12*a*, 12*b* in detail, it can be seen that the clamp posts 22, 24 have a generally circular bore 70 extending transversely therethrough above the upper surface of the platform portion 14 and generally perpendicular to the vertical faces 18, 20 of the corner post 16. As best seen in FIG. 7, the clamp posts 22, 24 also have a recess 72 extending vertically upwardly from the bottom thereof and traversing the bore 70.

Seated in each recess 72 is a nut 74 which is internally threaded and extends across the bore 70. The nut 74 threadably receives the threaded shank 76 of the elongated clamping member 78. In this fashion, the nut 74 is trapped within the recess 72, and rotation of the clamping member 78 moves the inwardly disposed end of the clamping member 78 towards and away from the cooperating vertical face 18, 20 of the corner post 16. To facilitate rotation of the clamping member 78, its outer end is provided with an enlarged handle 80.

On the inner end of the clamping member 78 is provided a generally cylindrical projection 82 of smaller diameter than the body of the clamping member 78 and which has a circumferential collar. A synthetic resin clamping shoe 84 of rectangular configuration has a bore of generally circular cross section to permit snap-fitting onto the cylindrical projection 82 to provide the clamping surface which will be disposed against the workpiece (not shown).

Figure 8:
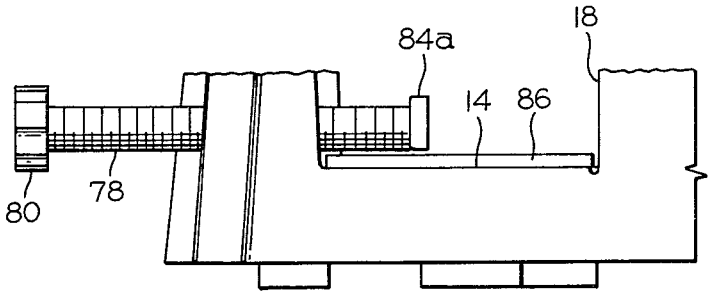
FIG. 8 is a fragmentary side elevational view of a mitre box embodiment employing a pivotable clamp shoe and with a wear member disposed on the platform portion.
Figure 9:
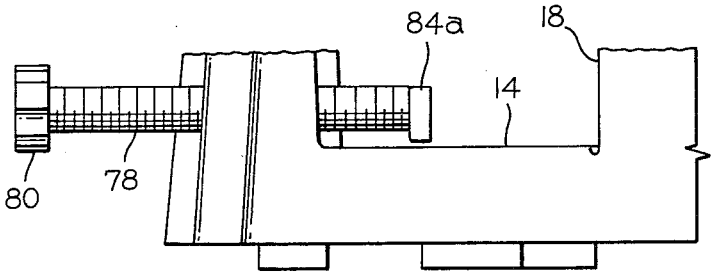
FIG. 9 is a view similar to FIG. 8 with the clamp shoe pivoted into its alternate position and omitting the wear member.

In FIGS. 8 and 9, another embodiment of clamping shoe **84*a* is employed which has the axis of its bore receiving the projection 82, offset from its horizontal center line. As a result, in the one position shown in FIG. 8, the shoe 84*a* is spaced above the upper surface of the platform portion 14 a distance sufficient to permit a wear member 86 to be placed on the platform portion 14 without interfering with the movement of the clamping member 78. Where no wear member is employed, the shoe 84*a* is pivoted 180° about the clamping member 78 to locate the shoe 84*a* closely adjacent to the upper surface of the platform portion 14** to ensure firm engagement with the workpiece (not shown).

In operation of the illustrated embodiment of the mitre box, the workpieces (not shown) to provide the adjacent sides of the frame are placed against the vertical faces 18, 20 of the corner post 16 and held in position against these faces by rotating the clamping members 78 to move the clamping shoes 84 against the edges of the workpieces to push the workpieces against the corner post 16. The saw (not shown) is then introduced into the channels 36 and 38, respectively, of the corner post 16 and saw guide post 34; reciprocation of the saw in these channels 36, 38 will cut the ends of the workpieces at a 45° angle. If so desired, the separately cut workpieces (not shown) may be simultaneously assembled in the mitre box against the respective vertical faces 18, 20 of the corner post 16, and the saw blade reciprocated in the channels 36, 38 to ensure essentially complementary surfaces.

To produce a squared off end, a workpiece (not shown) may be placed upon the upper surface of the platform portion 14 against the vertical face 18 of the post 16 and clamped thereagainst by the clamping shoe 84 of the clamp assembly **12*a*. When the saw blade (not shown) is introduced into the channel 40 of the corner post 16 and the channel 42 of the clamp corner post 22** and reciprocated, it will produce a 90° cut.

To minimize wear or cutting action of the saw blade (not shown) upon the upper surface of the support member 14 and to space the cutting edge of the saw blade from the upper surface of the support member 14, a wear piece or shim 66 is desirably employed under the workpiece (not shown) as indicated in FIG. 8 of the drawings. Such shims or wear pieces conveniently comprise composition board, shim stock, or the like.

The support member is readily molded as an integral member by injection molding techniques although compression molding may also be employed. Various resins may be employed including acrylonitrile/butadiene/styrene (ABS), polycarbonate, impact styrene, polypropylene, and polyamide; ABS resins have been found to provide a useful balance of properties at relatively low cost.

The adjusting screws comprising the elongated members of the clamp assemblies may be fabricated from metal if so desired, but have been found to be conveniently produced by molding from glass fiber reinforced resins such as polyamides (nylon) and the like. The clamping shoe is conveniently fabricated by molding it from glass fiber reinforced resins such as polypropylene.

The nut may be fabricated from metal or from synthetic resins; for convenience and optimum wear resistance, metal nuts have been found preferable.

The channels in the upper surface of the platform portion may be provided solely to show the user where the saw cuts will occur when the saw blade is located in the posts between which the channel extends, thus facilitating orientation of the workpiece in the proper location, etc. Moreover, they also tend to break up the large flat surface to improve the appearance of the mitre box. If so desired, the slots can be of a large enough width to accept the width of the saw teeth and thus minimize the likelihood of cutting of the platform portion when no underlying shim piece is employed.

In addition, although the saw guide slots in the several posts are shown as extending below the upper surface of the platform portion, they may terminate in the plane of the upper surface of the platform portion since the saw blade will not normally cut below that plane.

It can be seen that the mitre box of the present invention may be readily assembled from a minimum number of parts. Following molding of the support member, the nuts are located in the recesses of the clamp posts, and the adjusting members are then inserted into the bores of the clamp posts and threadably passed through the nuts, thus locking the nuts in position within the clamp posts. In the final step, the clamp shoes are snap fit onto the ends of the adjusting screws.

Thus, it can be seen from the foregoing detailed description and attached drawings that the mitre box of the present invention is one which may be ready and economically fabricated using synthetic resins in large measure to reduce cost and weight while providing durability. Moreover, the support member is so fabricated as to provide stable and accurate guidance for the saw blade in making the desired cuts in the workpieces.

Having thus described the invention we claim:

1. A mitre box especially adapted for making frame pieces comprising:

A. a support member integrally formed from synthetic resin and including a platform portion providing a generally planar upper surface, a corner post extending upwardly therefrom and having right angularly disposed vertical faces bordering said upper surface of said platform portion, clamp posts spaced to the opposite sides of said upper surface of said platform portion from said vertical faces of said corner post and extending upwardly from said platform portion, and a saw guide post extending upwardly from said upper surface of said platform portion between said clamp posts on the side thereof opposite from said corner post, said corner post having a channel therein extending transversely therethrough and downwardly thereinto from its top surface, said channel bisecting the 90° angle defined by the cooperating vertical faces of said corner post, said saw guide post having a channel extending transversely therethrough and downwardly thereinto from its top surface, said saw guide post channel being aligned with said corner post channel so that a saw blade may be guided by said channels to cut the end of a workpiece extending parallel to and abutting either one of said corner post vertical faces at substantially a 45° angle, said corner post having a second vertical channel therein spaced from said first mentioned channel and extending transversely therethrough and downwardly thereinto along a line perpendicular to one of said right angularly disposed vertical faces of said corner post, the clamp post cooperating with said one vertical face having a channel therein aligned with said second channel of each corner post, said channel of said clamp post extending transversely therethrough and downwardly thereinto from the top surfaces thereof, whereby a saw blade may be guided by said second channel of said corner post and said channel of said clamp post to cut the end of an associated workpiece extending parallel to said one vertical face at substantially a 90° angle;

B. clamp assemblies adjustably mounted in said clamp posts, each said clamp including an elongated member having its longitudinal axis extending perpendicularly to the cooperating face of said corner post and threadably engaged in its post for adjustable movement towards and away from the cooperating vertical face of said corner post, the end of said elongated member adjacent said corner post having a clamping face for engagement with the associated workpiece to hold it against the cooperating face of said corner post.

2. The mitre box in accordance with claim 2 wherein said clamp posts have recesses therein extending transversely of said elongated members and said clamp assemblies include internally threaded members seated in said recesses and through which said elongated members threadably extend to provide said adjustable movement.

3. The mitre box in accordance with claim 1 wherein said elongated members have handle means at the other end thereof to facilitate manual adjustment thereof.

4. The mitre box in accordance with claim 1 wherein said clamp assemblies include a separately formed clamp shoe mounted on the clamping end of said elongated members to provide said clamping face.

5. The mitre box in accordance with claim 4 wherein said clamping shoe has an aperture therein disengageably receiving the end of said elongated member, said aperture being spaced more closely to one horizontally extending surface of said shoe than to the other, whereby pivoting said shoe 180° about the elongated member will vary the spacing of said shoe above said upper surface of said platform portion.

6. The mitre box in accordance with claim 4 wherein said shoe is fabricated from synthetic resin.

7. The mitre box in accordance with claim 1 wherein said channels extend from the top surfaces of said posts to below the plane of the upper surface of said platform portion.

8. The mitre box in accordance with claim 7 wherein the upper surface of said platform portion has a channel therein extending between the channels of said saw guide post and corner post.

9. The mitre box in accordance with claim 1 wherein said support member has a lower surface defined by a peripheral skirt and a multiplicity of intersecting ribs.

10. The mitre box in accordance with claim 1 wherein said post members are of generally hollow construction with transverse ribs providing the walls defining said channels.

11. The mitre box in accordance with claim 1 wherein said support member has a spaced pair of depending foot portions adapted to abut the sides of a worktable or the like.

12. The mitre box in accordance with claim 11 wherein said foot portions have first vertical surfaces extending in alignment to permit stable placement against a longitudinal edge of the associated worktable and a pair of opposed surfaces defining a right angle therebetween to permit stable placement at the corner of an associated worktable.

* * * * *

UNITED STATES PATENT AND TRADEMARK OFFICE

CERTIFICATE OF CORRECTION

PATENT NO. : 4,437,375
DATED : March 20, 1984
INVENTOR(S) : I. James Elmore et al It is certified that error appears in the above—identified patent and that said Letters Patent is hereby corrected as shown below:

Column 7, line 42, "2" should be -- 1 --

Signed and Sealed this

*Thirtieth* Day of *October 1984*

[SEAL]

*Attest:*

GERALD J. MOSSINGHOFF

*Attesting Officer*

*Commissioner of Patents and Trademarks*